US012281400B1

(12) United States Patent
Chen et al.

(10) Patent No.: US 12,281,400 B1
(45) Date of Patent: Apr. 22, 2025

(54) DECARBOXYLATION COUPLING ELECTROCATALYSIS METHOD FOR CATALYZING AROMATIC TRIMETHYL AMMONIUM SALT AND α-NICKEL KETONATE

(71) Applicant: CHANGZHOU INSTITUTE OF TECHNOLOGY, Changzhou (CN)

(72) Inventors: Xiaohui Chen, Changzhou (CN); Yiyi Chen, Changzhou (CN); Xianqiang Kong, Changzhou (CN); Shuangquan Zhang, Changzhou (CN)

(73) Assignee: CHANGZHOU INSTITUTE OF TECHNOLOGY, Changzhou (CN)

( * ) Notice: Subject to any disclaimer, the term of this patent is extended or adjusted under 35 U.S.C. 154(b) by 0 days.

(21) Appl. No.: 18/387,488

(22) Filed: Nov. 7, 2023

(51) Int. Cl.

| | |
|---|---|
| ***C25B 3/07*** | (2021.01) |
| ***C25B 3/11*** | (2021.01) |
| ***C25B 3/23*** | (2021.01) |
| ***C25B 3/29*** | (2021.01) |
| ***C25B 11/043*** | (2021.01) |
| ***C25B 15/08*** | (2006.01) |

(52) U.S. Cl.
CPC ..... *C25B 3/29* (2021.01); *C25B 3/07* (2021.01); *C25B 3/11* (2021.01); *C25B 11/043* (2021.01); *C25B 15/083* (2021.01)

(58) Field of Classification Search
CPC ..... C25B 3/07; C25B 3/23; C25B 3/29
USPC ..... 205/446, 447
See application file for complete search history.

(56) References Cited

U.S. PATENT DOCUMENTS 4,459,186 A * 7/1984 Malloy ..... C25B 3/23 568/309

OTHER PUBLICATIONS

Lukas J. Gooben, et al., Synthesis of Ketones from α-Oxocarboxylates and Aryl Bromides by Cu/Pd-Catalyzed Decarboxylative Cross-Coupling, Angewandte Chemie, 2008, pp. 3043-3045, vol. 47 No. 16.

* cited by examiner

*Primary Examiner* — Edna Wong
(74) *Attorney, Agent, or Firm* — Bayramoglu Law Offices LLC

(57) ABSTRACT

A decarboxylation coupling electrocatalysis method for catalyzing an aromatic trimethyl ammonium salt and α-nickel ketonate is provided. The method includes the following steps: step 1, adding aryl-ammonium trifluoromethyl sulfonate, α-keto acid and sodium acetate in a molar ratio of 1:2:2 into a reaction bottle in a nitrogen atmosphere, adding an electrolyte n-$Bu_4NBF_4$, and then adding a mixed solution of acetonitrile and N,N-dimethylformamide, where a volume ratio of the acetonitrile to the N,N-dimethylformamide is 1:4; and step 2, stirring a mixture in step 1 so as to dissolve the mixture, inserting two electrodes, using a graphite electrode as a positive electrode and a nickel electrode as a negative electrode, adding water for stirring after a reaction, and conducting extraction, drying and purification to obtain an aromatic ketone compound.

9 Claims, 1 Drawing Sheet

--Prior Art--

X = Cl, Br, OTf, $N_2BF_4$; R = aryl, alkyl, OEt, OMe

DECARBOXYLATION COUPLING ELECTROCATALYSIS METHOD FOR CATALYZING AROMATIC TRIMETHYL AMMONIUM SALT AND α-NICKEL KETONATE

TECHNICAL FIELD

The present disclosure relates to a design of a decarboxylation coupling electrocatalysis method, and particularly relates to a decarboxylation coupling electrocatalysis method for catalyzing an aromatic trimethyl ammonium salt and α-nickel ketonate.

BACKGROUND

Aromatic aldehydes, ketones, amides and ester compounds have been widely used in synthetic chemistry, medicine, pesticides, electronic materials and other fields. A method for quickly synthesizing aromatic aldehydes, ketones, amides and ester compounds under mild conditions has become a hot issue. Especially under inspiration of construction of multifunctional C—C and C—X bonds through a cross-linking reaction catalyzed by transition metals, many decarboxylation cross-linking reactions catalyzed by transition metals have appeared in recent decades. That is, an aromatic ketone compound is prepared from cheap and readily available α-keto acid and its derivatives.

Up to now, the aromatic ketone compound is mainly prepared by using noble metal catalysts, and each solution has a limited substrate range. In 2008, the Goossen team proved for the first time that aryl halides and α-potassium ketonate can be decarboxylated to form aryl ketones under the catalysis of platinum/copper. The reaction is as follows:

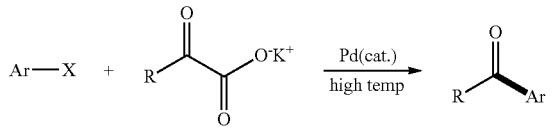

X = Cl, Br, OTf, $N_2BF_4$; R = aryl, alkyl, OEt, OMe (Reference: L. J. Goossen, F. Rudolphi, C. Oppel, N. Rodriguez, Synthesis of Ketones from a-Oxocarboxylates and Aryl Bromides by Cu/Pd-Catalyzed Decarboxylative Cross-Coupling, Angew. Chem. Int. Ed. 2008, 47, 3043-3045.) The team further expanded a substrate range to aryl potassium trifluorosulfonate later. However, this method for preparing an aromatic carbonyl compound can use expensive palladium catalysts and is very high in reaction temperature. At present, there is no reaction method for decarboxylation and arylation of α-keto acid by using a new electrophilic reagent under mild reaction conditions and without using a noble metal catalyst in the prior art.

SUMMARY

In order to solve the problem, the present disclosure provides a decarboxylation coupling electrocatalysis method for catalyzing an aromatic trimethyl ammonium salt and α-nickel ketonate. The method can effectively solve the technical problem proposed in the background art.

In order to solve the above technical problem, a technical solution used in the present disclosure is a decarboxylation coupling electrocatalysis method for catalyzing an aromatic trimethyl ammonium salt and α-nickel ketonate. The method includes the following steps: step 1, adding aryl-ammonium trifluoromethyl sulfonate, α-keto acid and sodium acetate in a molar ratio of 1:2:2 into a reaction bottle in a nitrogen atmosphere, adding an electrolyte n-$Bu_4NBF_4$, and then adding a mixed solution of acetonitrile and N,N-dimethylformamide, where a volume ratio of the acetonitrile to the N,N-dimethylformamide is 1:4;

step 2, stirring a mixture in step 1 so as to dissolve the mixture, inserting two electrodes, using a graphite electrode as a positive electrode and a nickel electrode as a negative electrode, applying constant voltage direct current of 12 mA, where a reaction temperature is 50° C., and power-on time is 6 h, adding water for stirring after a reaction, and conducting extraction, drying and purification to obtain an aromatic ketone compound; and step 3, using a preparation formula as follows:

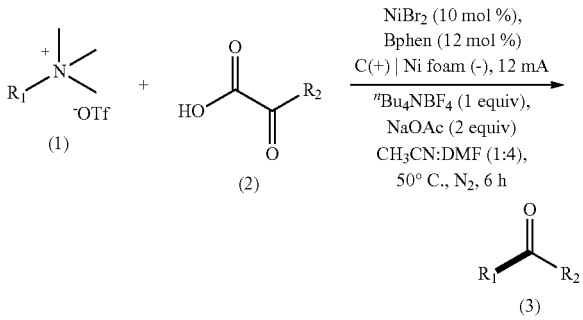

where $R_1$ is an aromatic group, and $R_2$ is an aromatic group or an aliphatic group.

Preferably, the $R_1$ may be a phenyl group, trifluorotoluene, methylbenzene, or naphthalene; and the $R_2$ may be a phenyl group, methylbenzene, naphthalene, or n-propyl.

Preferably, a structural formula of the aromatic ketone compound is

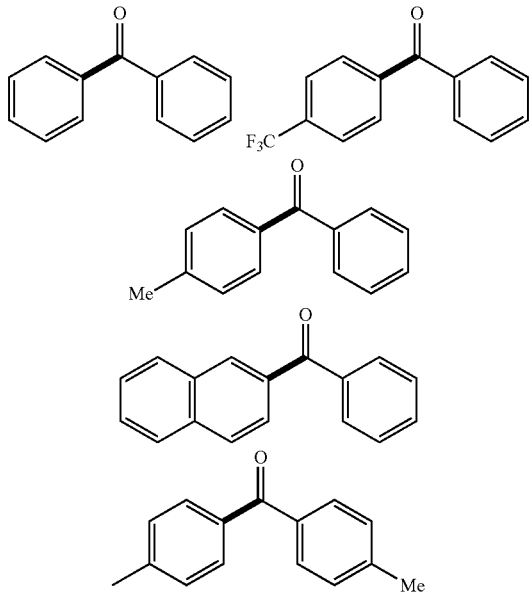

-continued

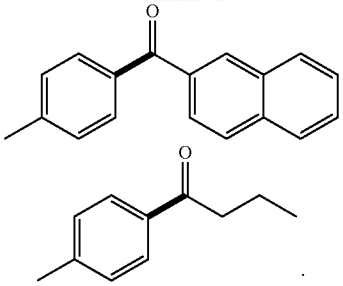

Preferably, the aryl-ammonium trifluoromethyl sulfonate in the preparation formula is specifically one of phenyltrimethyl ammonium trifluoromethylsulfonate, trifluorotoluene-trimethyl ammonium trifluoromethylsulfonate, toluene-trimethyl ammonium trifluoromethylsulfonate, and naphthyl-trimethyl ammonium trifluoromethylsulfonate.

Preferably, the α-keto acid in the preparation formula is specifically one of phenylglyoxylic acid, p-methyl-phenylglyoxylic acid, 2-naphthoformic acid, and butyraldehyde formic acid.

Preferably, a concentration of the aryl-ammonium trifluoromethyl sulfonate in a solvent is 0.30 mmol/L.

Preferably, a concentration of the electrolyte n-$Bu_4NBF_4$ is 0.30 mmol/L.

Preferably, an extractant used in the extraction step is a mixed solution of petroleum ether and ethyl acetate.

Preferably, the purification step uses a column chromatography isolation method.

The decarboxylation coupling electrocatalysis method for catalyzing an aromatic trimethyl ammonium salt and α-nickel ketonate according to the present disclosure can achieve the following beneficial effects:

(1) The present disclosure uses the aryl-ammonium trifluoromethyl sulfonate and the α-keto acid as raw materials and the mixed solution of the N,N-dimethylformamide and the acetonitrile as the solvent, and prepares the aromatic ketone compound through an electrochemical method, which can achieve a yield not lower than 60%.

(2) Compared with a traditional method for synthesizing an aromatic ketone compound, the method has low requirements on instruments and devices, uses no noble metal catalysts, reduces cost, and is mild in reaction conditions, simple in operation steps, and short in reaction time, and can be applied to scientific research, medical treatment, industry and other fields.

DETAILED DESCRIPTION OF THE EMBODIMENTS

Figure 1:
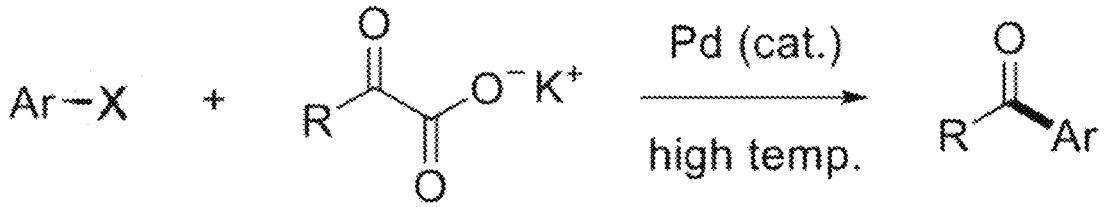
FIG. 1 shows a preparation formula in the prior art.
Figure 2:
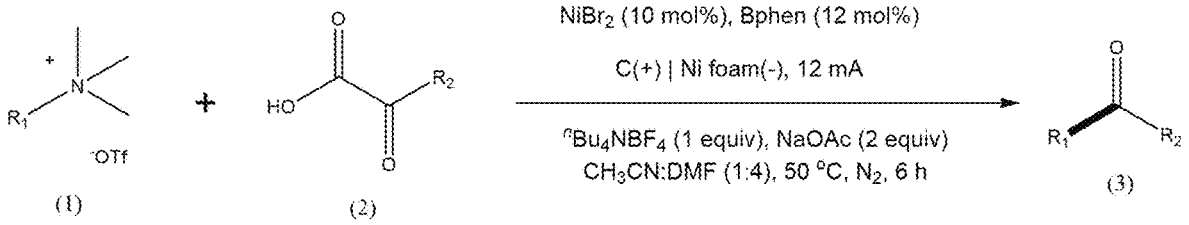
FIG. 2 shows a preparation formula of the present disclosure.

The present disclosure will be further described below with reference to the accompanying drawings. The following examples are merely used for describing a technical solution of the present disclosure more clearly, instead of limiting the protection scope of the present disclosure.

A computation method of a yield is:yield=(actual) target product production/theoretical target product production×100%.

Example 1 Preparation of Benzophenone 77.4 mg (0.30 mmol) of phenyl-trimethyl ammonium trifluoromethylsulfonate, 90 mg (0.60 mmol) of phenylglyoxylic acid and 49.2 mg (0.60 mmol) of sodium acetate were added into a 10 mL diaphragm-free electrolytic cell, and dissolution and stirring were conducted with 8 mL of a mixed solution of N,N-dimethylformamide and acetonitrile. Nickel foam (10×10×0.3 mm) was used as a cathode electrode, a graphite rod (I=6 mm) was used as an anode electrode, 12 mA constant current was applied, a reaction was conducted at 50° C. for 6 h, after the reaction, a reaction liquid was taken out and added into a separatory funnel, 20 mL of water was added, a water phase was extracted with petroleum ether and ethyl acetate, an organic phase was dried with anhydrous sodium sulfate, and 44.8 mg of benzophenone was obtained through a column chromatography isolation method, where a yield was 82%. A structural formula of a product obtained was as follows:

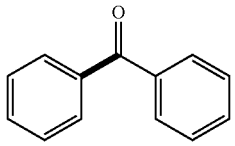

$_1$H NMR (500 MHz, Chloroform-d) δ 7.89-7.80 (m, 4H), 7.63-7.60 (m, 2H), 7.56-7.47 (m, 4H). 13C NMR (126 MHz, $CDCl_3$) δ 196.8, 137.6, 132.4, 130.1, 128.3.

Example 2 Preparation of 4-trifluoromethylbBenzophenone 97.8 mg (0.30 mmol) of trifluorotoluene-trimethyl ammonium trifluoromethylsulfonate, 90 mg (0.60 mmol) of phenylglyoxylic acid and 49.2 mg (0.60 mmol) of sodium acetate were added into a 10 mL diaphragm-free electrolytic cell, and dissolution and stirring were conducted with 8 mL of a mixed solution of N,N-dimethylformamide and acetonitrile. Nickel foam (10×10×0.3 mm) was used as a cathode electrode, a graphite rod (I=6 mm) was used as an anode electrode, 12 mA constant current was applied, a reaction was conducted at 50° C. for 6 h, after the reaction, a reaction liquid was taken out and added into a separatory funnel, 20 mL of water was added, a water phase was extracted with petroleum ether and ethyl acetate, an organic phase was dried with anhydrous sodium sulfate, and 61.5 mg of 4-trifluoromethyl benzophenone was obtained through a column chromatography isolation method, where a yield was 82%. A structural formula of a product obtained was as follows:

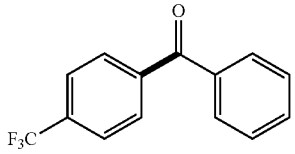

$_1$H NMR (500 MHz, Chloroform-d) δ 7.92 (d, J=8.0 Hz, 2H), 7.83 (d, J=7.6 Hz, 2H), 7.78 (d, J=8.0 Hz, 2H), 7.65 (t, J=7.4 Hz, 1H), 7.53 (t, J=7.6 Hz, 2H). $^{13}$C NMR (101 MHz, $CDCl_3$) δ 195.5, 140.7, 136.7, 133.7 (d, J=32.3 Hz), 133.1, 130.13, 130.09, 128.5, 125.3 (d, J=3.7 Hz), 123.6 (d, J=273.7 Hz). $^{19}$F NMR (376 MHz, CDCl3) δ-62.60.

Example 3 Preparation of 4-methyl benzophenone 81.6 mg (0.30 mmol) of toluene-trimethyl ammonium trifluoromethylsulfonate, 90 mg (0.60 mmol) of phenylglyoxylic acid and 49.2 mg (0.60 mmol) of sodium acetate were added into a 10 mL diaphragm-free electrolytic cell, and dissolution and stirring were conducted with 8 mL of a mixed solution of N,N-dimethylformamide and acetonitrile. Nickel foam (10×10×0.3 mm) was used as a cathode electrode, a graphite rod (I=6 mm) was used as an anode electrode, 12 mA constant current was applied, a reaction was conducted at 50° C. for 6 h, after the reaction, a reaction liquid was taken out and added into a separatory funnel, 20 mL of water was added, a water phase was extracted with petroleum ether and ethyl acetate, an organic phase was dried with anhydrous sodium sulfate, and 47.0 mg of 4-methyl benzophenone was obtained through a column chromatography isolation method, where a yield was 80%. A structural formula of a product obtained was as follows:

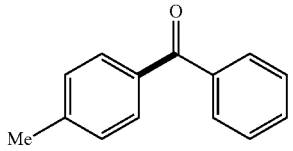

$^{1}$H NMR (500 MHz, Chloroform-d) δ 7.84-7.79 (m, 2H), 7.78-7.72 (m, 2H), 7.62-7.57 (m, 1H), 7.50 (dd, J=8.4, 7.0 Hz, 2H), 7.30 (d, J=7.9 Hz, 2H), 2.46 (s, 3H). $^{13}$C NMR (126 MHz, $CDCl_3$) δ 196.5, 143.3, 138.0, 134.9, 132.2, 130.3, 130.0, 129.0, 128.2, 21.7.

Example 4 Preparation of 1-naphthyl benzophenone 92.4 mg (0.30 mmol) of naphthyl-trimethyl ammonium trifluoromethylsulfonate, 90 mg (0.60 mmol) of phenylglyoxylic acid and 49.2 mg (0.60 mmol) of sodium acetate were added into a 10 mL diaphragm-free electrolytic cell, and dissolution and stirring were conducted with 8 mL of a mixed solution of N,N-dimethylformamide and acetonitrile. Nickel foam (10×10×0.3 mm) was used as a cathode electrode, a graphite rod (I=6 mm) was used as an anode electrode, 12 mA constant current was applied, a reaction was conducted at 50° C. for 6 h, after the reaction, a reaction liquid was taken out and added into a separatory funnel, 20 mL of water was added, a water phase was extracted with petroleum ether and ethyl acetate, an organic phase was dried with anhydrous sodium sulfate, and 52.2 mg of 1-naphthyl benzophenone was obtained through a column chromatography isolation method, where a yield was 75%. A structural formula of a product obtained was as follows:

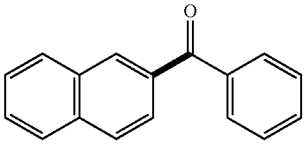

$^{1}$H NMR (500 MHz, Chloroform-d) δ 8.30 (d, J=1.2 Hz, 1H), 7.98 (d, J=1.5 Hz, 2H), 7.94 (ddt, J=7.4, 2.4, 1.4 Hz, 2H), 7.92-7.88 (m, 2H), 7.68-7.61 (m, 2H), 7.61-7.57 (m, 1H), 7.57-7.52 (m, 2H). $^{13}$C NMR (126 MHz, $CDCl_3$) δ 196.8, 137.9, 135.3, 134.8, 132.4, 132.3, 131.9, 130.1, 129.4, 128.4, 128.4, 128.3, 127.8, 126.8, 125.8.

Example 5 Preparation of 4-dimethyl benzophenone 81.6 mg (0.30 mmol) of toluene-trimethyl ammonium trifluoromethylsulfonate, 98.4 mg (0.60 mmol) of p-methylphenylglyoxylic acid and 49.2 mg (0.60 mmol) of sodium acetate were added into a 10 mL diaphragm-free electrolytic cell, and dissolution and stirring were conducted with 8 mL of a mixed solution of N,N-dimethylformamide and acetonitrile. Nickel foam (10×10×0.3 mm) was used as a cathode electrode, a graphite rod (I=6 mm) was used as an anode electrode, 12 mA constant current was applied, a reaction was conducted at 50° C. for 6 h, after the reaction, a reaction liquid was taken out and added into a separatory funnel, 20 mL of water was added, a water phase was extracted with petroleum ether and ethyl acetate, an organic phase was dried with anhydrous sodium sulfate, and 52.9 mg of 4-dimethyl benzophenone was obtained through a column chromatography isolation method, where a yield was 84%. A structural formula of a product obtained was as follows:

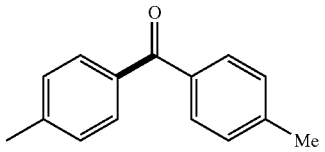

$_{1}$H NMR (500 MHz, Chloroform-d) δ 7.79-7.65 (m, 4H), 7.29 (dd, J=8.2, 2.2 Hz, 4H), 2.46 (s, 6H). $_{13}$C NMR (126 MHz, $CDCl_3$) δ 196.3, 143.0, 135.2, 130.2, 128.9, 21.6.

Example 6 Preparation of 1-naphthyl methyl benzophenone 81.6 mg (0.30 mmol) of toluene-trimethyl ammonium trifluoromethylsulfonate, 120.0 mg (0.60 mmol) of 2-naphthoformic acid and 49.2 mg (0.60 mmol) of sodium acetate were added into a 10 mL diaphragm-free electrolytic cell, and dissolution and stirring were conducted with 8 mL of a mixed solution of N,N-dimethylformamide and acetonitrile. Nickel foam (10×10×0.3 mm) was used as a cathode electrode, a graphite rod (I=6 mm) was used as an anode electrode, 12 mA constant current was applied, a reaction was conducted at 50° C. for 6 h, after the reaction, a reaction liquid was taken out and added into a separatory funnel, 20 mL of water was added, a water phase was extracted with petroleum ether and ethyl acetate, an organic phase was dried with anhydrous sodium sulfate, and 53.9 mg of 1-naphthyl methyl benzophenone was obtained through a column chromatography isolation method, where a yield was 73%. A structural formula of a product obtained was as follows:

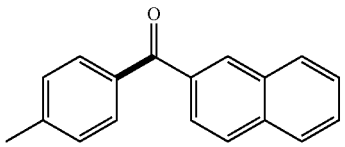

$^1$H NMR (400 MHz, Chloroform-d) δ 8.17 (s, 1H), 7.86-7.80 (m, 4H), 7.70 (d, J=7.9 Hz, 2H), 7.49 (dddd, J=22.5, 8.1, 6.9, 1.4 Hz, 2H), 7.23 (d, J=7.9 Hz, 2H), 2.38 (s, 3H). $^{13}$C NMR (101 MHz, $CDCl_3$) δ 196.6, 143.2, 135.2, 132.3, 131.6, 130.4, 129.4, 129.1, 128.2, 128.2, 127.8, 126.8, 125.9, 21.7.

Example 7 Preparation of 4-methyl phenylbutanone 81.6 mg (0.30 mmol) of toluene-trimethyl ammonium trifluoromethylsulfonate, 69.6 mg (0.60 mmol) of butyraldehyde formic acid and 49.2 mg (0.60 mmol) of sodium acetate were added into a 10 mL diaphragm-free electrolytic cell, and dissolution and stirring were conducted with 8 mL of a mixed solution of N,N-dimethylformamide and acetonitrile. Nickel foam (10×10×0.3 mm) was used as a cathode electrode, a graphite rod (I=6 mm) was used as an anode electrode, 12 mA constant current was applied, a reaction was conducted at 50° C. for 6 h, after the reaction, a reaction liquid was taken out and added into a separatory funnel, 20 mL of water was added, a water phase was extracted with petroleum ether and ethyl acetate, an organic phase was dried with anhydrous sodium sulfate, and 31.6 mg of 4-methyl phenylbutanone was obtained through a column chromatography isolation method, where a yield was 65%. A structural formula of a product obtained was as follows:

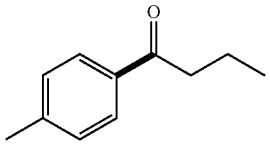

$^1$H NMR (500 MHz, Chloroform-d) δ 7.88 (dd, J=8.2, 1.6 Hz, 2H), 7.27 (d, J=7.9 Hz, 2H), 2.99 (dtd, J=7.2, 6.0, 2.0 Hz, 2H), 2.42 (d, J=3.5 Hz, 3H), 1.23 (td, J=7.3, 1.6 Hz, 3H). $^{13}$C NMR (126 MHz, $CDCl_3$) δ 200. 6, 143.6, 134.5, 129.2, 128.1, 31.7, 21.6.

What are described above are merely the preferred embodiments of the disclosure. It should be noted that those of ordinary skill in the art can also make some improvements and transformations without departing from the technical principle of the present disclosure, and these improvements and transformations should also fall within the protection scope of the present disclosure.

What is claimed is:

1. A decarboxylation coupling electrocatalysis method for catalyzing an aromatic trimethyl ammonium salt and α-nickel ketonate, comprising the following steps:

step 1, adding aryl-ammonium trifluoromethyl sulfonate (1), α-keto acid (2), and sodium acetate in a molar ratio of 1:2:2 into a reaction bottle in a nitrogen atmosphere, adding an electrolyte n-$Bu_4NBF_4$, and then adding a mixed solution of acetonitrile and N,N-dimethylformamide to obtain a resulting mixture, wherein a volume ratio of the acetonitrile to the N,N-dimethylformamide is 1:4;

step 2, stirring the resulting mixture in step 1 to dissolve the resulting mixture, inserting two electrodes, using a graphite electrode as a positive electrode and a nickel foam electrode as a negative electrode, applying a constant voltage direct current of 12 mA for a reaction, wherein a reaction temperature is 50° C. and a power-on time is 6 h, adding water for stirring after the reaction, and conducting an extraction, a drying, and a purification to obtain an aromatic ketone compound (3); and step 3, using a preparation formula as follows:

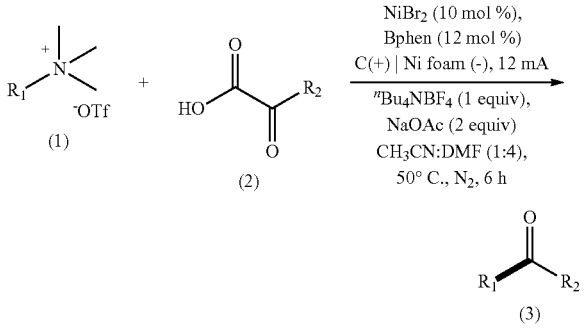

wherein $R_1$ is an aromatic group, and $R_2$ is an aromatic group or an aliphatic group.

2. The decarboxylation coupling electrocatalysis method for catalyzing the aromatic trimethyl ammonium salt and the α-nickel ketonate according to claim 1, wherein the $R_1$ is a phenyl group, trifluorotoluene, methylbenzene, or naphthalene; and the $R_2$ is a phenyl group, methylbenzene, naphthalene, or n-propyl.

3. The decarboxylation coupling electrocatalysis method for catalyzing the aromatic trimethyl ammonium salt and the α-nickel ketonate according to claim 1, wherein a structural formula of the aromatic ketone compound is

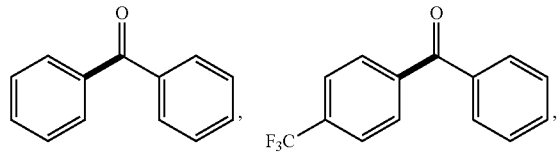

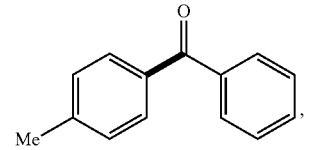

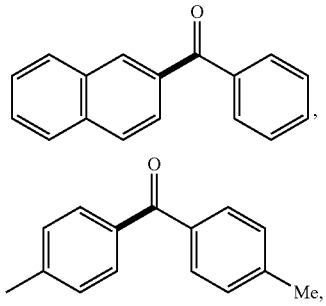

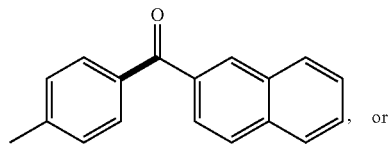

-continued

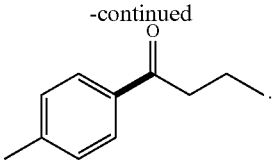

4. The decarboxylation coupling electrocatalysis method for catalyzing the aromatic trimethyl ammonium salt and the α-nickel ketonate according to claim 1, wherein the aryl-ammonium trifluoromethyl sulfonate in the preparation formula is specifically one of phenyl-trimethyl ammonium trifluoromethylsulfonate, trifluorotoluene-trimethyl ammonium trifluoromethylsulfonate, toluene-trimethyl ammonium trifluoromethylsulfonate, and naphthyl-trimethyl ammonium trifluoromethylsulfonate.

5. The decarboxylation coupling electrocatalysis method for catalyzing the aromatic trimethyl ammonium salt and the α-nickel ketonate according to claim 1, wherein the α-keto acid in the preparation formula is specifically one of phenylglyoxylic acid, p-methyl-phenylglyoxylic acid, 2-naphthoformic acid, and butyraldehyde formic acid.

6. The decarboxylation coupling electrocatalysis method for catalyzing the aromatic trimethyl ammonium salt and the α-nickel ketonate according to claim 1, wherein a concentration of the aryl-ammonium trifluoromethyl sulfonate in a solvent is 0.30 mmol/L.

7. The decarboxylation coupling electrocatalysis method for catalyzing the aromatic trimethyl ammonium salt and the α-nickel ketonate according to claim 1, wherein a concentration of the electrolyte n-$Bu_4NBF_4$ is 0.30 mmol/L.

8. The decarboxylation coupling electrocatalysis method for catalyzing the aromatic trimethyl ammonium salt and the α-nickel ketonate according to claim 1, wherein an extractant used in the extraction is a mixed solution of petroleum ether and ethyl acetate.

9. The decarboxylation coupling electrocatalysis method for catalyzing the aromatic trimethyl ammonium salt and the α-nickel ketonate according to claim 1, wherein the purification uses a column chromatography isolation method.

* * * * *